US009601240B2

(12) United States Patent
Hoefner

(10) Patent No.: US 9,601,240 B2
(45) Date of Patent: Mar. 21, 2017

(54) HIGH-VOLTAGE INSULATOR

(75) Inventor: Roland Hoefner, Kueps (DE)

(73) Assignee: MASCHINENFABRIK REINHAUSEN GMBH, Regensburg (DE)

( * ) Notice: Subject to any disclaimer, the term of this patent is extended or adjusted under 35 U.S.C. 154(b) by 294 days.

(21) Appl. No.: 13/581,370

(22) PCT Filed: Mar. 12, 2011

(86) PCT No.: PCT/EP2011/001228

§ 371 (c)(1),
(2), (4) Date: Sep. 26, 2012

(87) PCT Pub. No.: WO2011/131273

PCT Pub. Date: Oct. 27, 2011

(65) Prior Publication Data

US 2013/0025912 A1 Jan. 31, 2013

(30) Foreign Application Priority Data

Apr. 21, 2010 (DE) ..... 10 2010 015 729

(51) Int. Cl.
*H01B 17/14* (2006.01)
*H01B 17/36* (2006.01)

(52) U.S. Cl.
CPC ..... *H01B 17/14* (2013.01); *H01B 17/36* (2013.01)

(58) Field of Classification Search
None
See application file for complete search history.

(56) References Cited

U.S. PATENT DOCUMENTS

| | | | | |
|---|---|---|---|---|
| 3,242,251 | A * | 3/1966 | Floessel | 174/18 |
| 4,024,339 | A * | 5/1977 | Meyer et al. | 174/21 C |
| 4,562,321 | A * | 12/1985 | Bolongeat-Mobleu et al. | 218/57 |
| 7,728,230 | B2 | 6/2010 | Ma | |
| 2001/0040046 | A1* | 11/2001 | Hoefner | H01B 17/42 174/158 R |
| 2009/0173515 | A1* | 7/2009 | Sjoberg | H01B 17/32 174/12 BH |

FOREIGN PATENT DOCUMENTS

| | | | |
|---|---|---|---|
| CH | 232740 | B | 9/1944 |
| CN | 2123808 | A | 12/1992 |
| CN | 200969258 | A | 10/2007 |
| DE | 1035719 | A | 8/1958 |
| EP | 1091365 | A | 4/2001 |
| EP | 1091365 | A1 * | 4/2001 |

* cited by examiner

*Primary Examiner* — Timothy Thompson
*Assistant Examiner* — Krystal Robinson
(74) *Attorney, Agent, or Firm* — Andrew Wilford

(57) ABSTRACT

A high-voltage insulator has at least two separate insulators that can be joined to create a post and that each have an essentially rotation-symmetrical support tube made of glass-fiber-reinforced epoxy resin and having an empty internal space, respective top and bottom metallic flanges that surround top and bottom ends of the respective support tube and close the respective tube's empty internal space with an air-tight seal relative to the outer atmosphere, and a shielding of silicone that fits around each support tube. A tubular coupling piece connects the at least two insulators in such a way that the respective empty internal spaces of the at least two insulators form a common gas space and pressure between the spaces is equalized through the coupling piece.

4 Claims, 2 Drawing Sheets

HIGH-VOLTAGE INSULATOR

CROSS REFERENCE TO RELATED APPLICATIONS

This application is the US-national stage of PCT application PCT/EP2011/001228 filed 12 Mar. 2011, published 27 Oct. 2011 as WO2011/131273, and claiming the priority of German patent application 102010015729.5 itself filed 21 Apr. 2010.

FIELD OF THE INVENTION

The invention relates to a high-voltage insulator, in particular, to a post insulator such as those used, for example, to support busbars or stranded conductors in high-voltage direct current transmission systems, abbreviated as HVDCT systems, or high-voltage installations.

BACKGROUND OF THE INVENTION

High-voltage direct current transmission enables high levels of electrical power to be transmitted over great distances with lower losses than is the case with alternating-current transmission systems, due to the fact that reactive power losses in alternating-current transmission systems become an increasingly important factor as the transmission path for the electric power becomes longer. For this reason, direct current transmission has technical advantages when given the same voltage but relatively great distances.

One- or multipart post insulators, i.e. those made of a plurality of individual insulators, have been used for decades to mount busbars or stranded conductors of an HVDCT system that are frequently at a height of 8 m. These previous post insulators are characterized by a ceramic solid core in order to withstand the high mechanical stresses, in particular, bending moments that may occur. Post insulators of this type that are provided with a solid ceramic core have been disclosed, for example, in CH 232740 or DE 1 035 719.

More recent developments, on the other hand, generally relate to hollow composite insulators, also usable as post insulators, that are made of glass-fiber-reinforced epoxy resin and include a shielding of silicone in which top and bottom ends are formed by metallic flanges, for example of aluminum. A method of making a composite insulator of this kind is disclosed in EP 1,091,365.

Due to its electrically insulating properties, the empty internal space of these composite insulators is filled, in particular, with sulfur hexafluoride, an inorganic chemical compound of the elements sulfur and fluorine with the molecular formula SF6. However, it must also be stated that any other insulating gas, such as, for example, nitrogen, can be considered for use here. Under normal conditions SF6 is a colorless, odorless gas that is noncombustible and is extremely inert, as is nitrogen similarly. It is a commonly found insulating gas for use in medium- and high-voltage engineering due to its high density, high ionization energy, and the property of binding free electrons.

The empty internal space of the composite insulators must be provided with an absolute seal relative to the outside atmosphere in order to ensure the effectiveness of the employed insulating gas over the full life of the composite insulator. To this end, each individual gas space is monitored in terms of its pressure conditions. A connection point for a protective monitoring device composed of at least one pressure sensor is provided for this purpose on the bottom flanges of the composite insulators in order to obtain information from the actual prevailing pressure conditions about the fill level or status of the empty internal space, which is filled with insulating gas, of the composite insulator.

This type of interior space monitoring entails a significant servicing cost, particularly in the case of multipart post insulators made of composite materials, i.e. with those that are assembled out of a plurality of separate hollow insulators to form a common post. If, for example, it is not the lowest but instead one of the following composite insulators of the multipart post insulator that must be inspected, the relevant stranded conductor or relevant busbar of the corresponding post insulator must be disconnect or deenergized by the monitoring device while the actual inspection is being performed. A further fundamental disadvantage of multipart post insulators is the separate monitoring of each individual post insulator.

OBJECT OF THE INVENTION

The object of this invention is therefore to provide a multipart post insulator made of composite materials in which inspection by a monitoring device can be effected by simple means, and, in particular, it is no longer necessary to disconnect the stranded conductor or busbars for this purpose.

SUMMARY OF THE INVENTION

The general inventive idea consists in using a coupling piece to connect the individual hollow post insulators made out of composite material in such a way that the respective empty internal spaces of the at least two separate post insulators create a single common gas space. In other words, a multipart hollow post insulator made of a composite material is provided according to the invention where the post's internal spaces that were previously filled separately with SF6 are now formed by the coupling piece into a common internal space having a common gas pressure. This inventive idea is advantageous in a plurality of respects relative to the prior art. Due to the monitoring device that includes at least one pressure measuring device, now only one common gas space needs to be monitored in terms of servicing, not each individual gas space as was previously the case. The fact that, in an especially advantageous approach, only one common connection point is now provided for the monitoring device on the bottom-most flange of the multipart hollow post insulator enables the respective stranded conductor or busbar that is held by the multipart hollow post insulator to remain operational, i.e. to conduct electrical current. Considered as a whole, this provides an enormous savings in terms of time and expense for the operator of the HVDCT installation.

In a preferred embodiment of the invention, the coupling piece is a sealing plug-type connector that connects each to flange of a lower hollow composite insulator to the bottom flange of an overlying hollow composite insulator so as to create a seal. As a result, the plurality of individual hollow composite insulators can be assembled on site so as to create a single post insulator that has a common gas space. In addition, the coupling piece is designed so as to provide positive mechanical guidance before the actual coupling action, i.e. before the coupling piece actually creates a gas-permeable connection between the individual insulators, which positive guidance facilitates the interconnection of the individual hollow composite insulators and ensures that no insulating gas escapes from the respective interior spaces of the hollow composite insulators to be connected.

In another preferred embodiment of the invention, the multipart hollow post insulator made of composite material can be filled with insulating gas, in particular, SF6, through a common connection point. The actual process here of filling the hollow multipart post insulator made of composite material can also be effected only after the actual installation on site, that is after assembly at its site of operation, which enormously simplifies transporting the large parts. The common connection point thus functions both to enable filling the multipart post insulator with preferably SF6, as well as to connect a monitoring device. Due to the physical properties of compressible fluids, which category includes SF6, the insulating gas diffuses uniformly throughout the entire internal space. As a result, the same pressure conditions thus ultimately prevail at the end of the filling process in the individual internal spaces of the respective hollow composite insulators that are connected by the coupling piece.

BRIEF DESCRIPTION OF THE DRAWING

By way of example, the following describes the invention in more detail with reference to drawings. Therein.

SPECIFIC DESCRIPTION OF THE INVENTION

Figure 1:
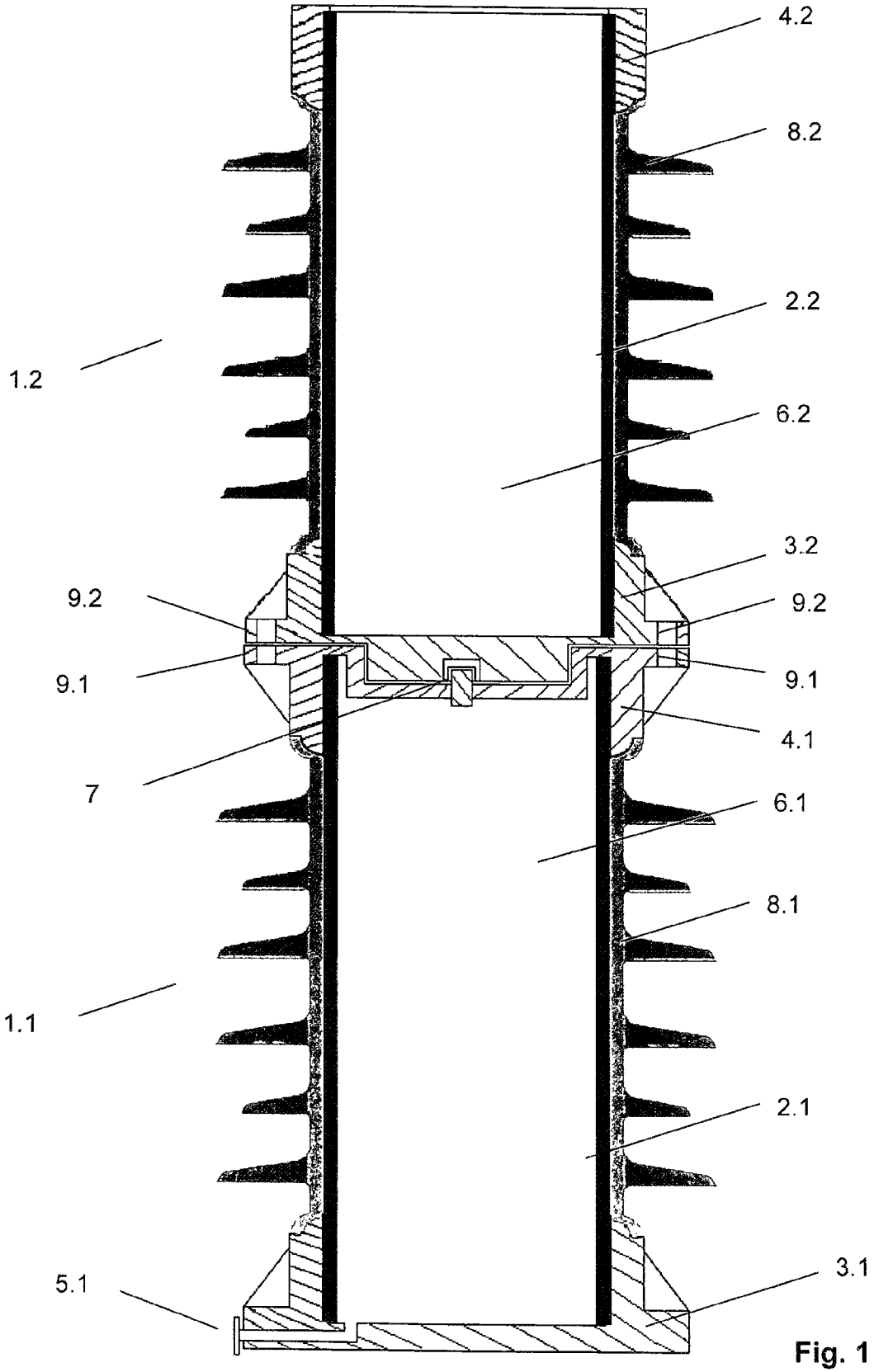
FIG. 1 is a schematic section through a multipart post insulator according to the invention.

FIG. 1 is a vertical section through a hollow composite insulator, i.e. one that can be assembled out of a plurality of separate insulators 1.1 and 1.2. Each of the at least two hollow composite top and bottom insulators 1.1 and 1.2 here comprises a respective essentially rotation-symmetrical support tube 2.1 and 2.2 that is generally made of glass-fiber-reinforced epoxy resin. An undulating silicone shielding 8.1 and 8.2 is provided on the outsides of the support tubes 2.1 and 2.2. Metallic flanges 3.1, 3.2, 4.1, and 4.2 made for example of aluminum are mounted on respective ends, i.e. on the upper and lower ends of the support tube 2.1 and 2.2 so as to provide positive engagement by externally surrounding the support tubes and being sealed thereto. The bottom flange 3.1 of the bottom insulator 1.1 here has a solid base. In addition, a connection 5.1 for an unillustrated monitoring device is provided in the solid base region of the bottom flange 3.1. The connection point 5.1 is designed so that it can alternatively also be used for filling empty internal spaces 6.1 and 6.2 of the top and bottom insulators 1.1 and 1.2 with insulating gas. This is possible according to the invention since a coupling piece 7 designed for example as a plug-type connector can create a gas-permeable connection between the top and bottom insulators 1.1 and 1.2. The bottom flange 3.2 of the top insulator 1.2 has a shape complementary to that of the top flange 4.1 and they engage each other here in such a way that a vertical mechanical positive guidance is provided first when the two top and bottom insulators 1.1 and 1.2 are fitted together before the actual gas-permeable connection is created by the coupling piece 7. The fact that now only one common gas space thus exists inside the two top and bottom insulators 1.1 and 1.2 means that now only the one common gas space for the complete multipart post insulator 1.1 and 1.2 needs to be checked during servicing by the unillustrated monitoring device that includes at least one pressure sensor. This saves the installation operator not only time but also expense. In order to secure them in place, the two flanges 3.2 and 4.1 are secured together for example by detachable screw fasteners. Throughgoing holes are provided in flange rings 9.1 and 9.2 for this purpose.

Figure 2:
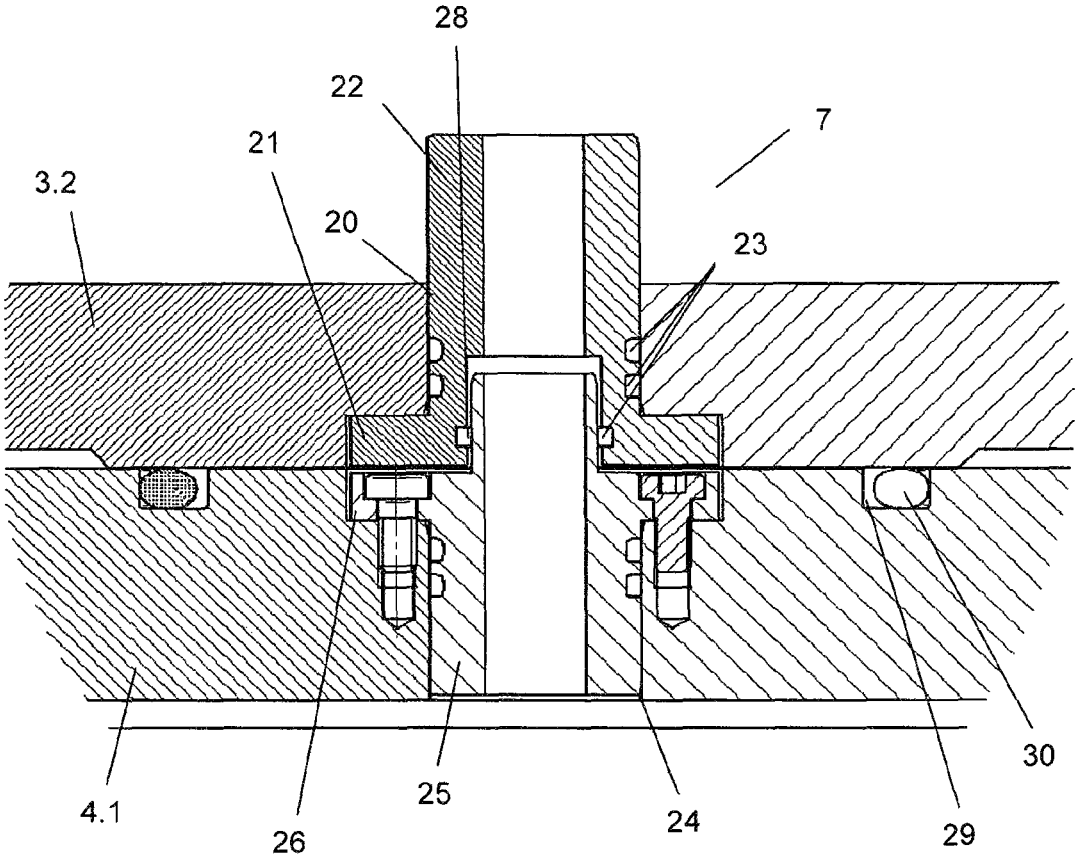
FIG. 2 is a detail view of the coupling piece according to the invention.

FIG. 2 is a detail view of the coupling piece 7 according to the invention, comprised essentially of a first coupling part 22 and a second coupling part 25. The top part of FIG. 1 shows how the bottom flange 3.2 of the top insulator 1.2 can be fitted with the top flange 4.1 of insulator 1.1. In order to prevent insulating gas from escaping between the two flanges 3.2 and 4.1 in the region of coupling piece 7, a groove 29 is formed concentrically around the coupling piece 7 and holds a ring seal 30 can be inserted so as to create a gas-tight connection.

The bottom flange 3.2 of the top insulator 1.2 is formed with a hole 20 into which the tubular first coupling part 22 is fitted. This first coupling part 22 furthermore has a circumferential collar 21 on its end juxtaposed with the flange 4.2. In addition, a plurality of circumferential grooves 23 are formed on the outer and inner surfaces of the tubular first coupling part 22 so as to enable annular seals—such as for example ring seals—to be provided therein, although only parts of the ring seals is shown in FIG. 2.

Opposite the opening 20, the top flange 4.1 of the bottom insulator 1.1 has another hole 24 into which the second coupling part 25 is fitted. The second coupling part 25 is also essentially tubular and has a collar 26 that can be screwed onto the top flange 4.1 of the bottom insulator 1.1. The actual end of the essentially tubular second coupling part 25 turned toward the bottom flange 3.2 of the top insulator 1.2 projects here by a certain distance into the tubular first coupling part 22. The inside diameter of the first coupling part 22 and the outside diameter of the second coupling part 25 are such that they differ from each other only by a few tenths of a millimeter where they axially overlap with the result that no insulating gas can escape between them. This is also true because a supplemental seal 28 is provided in one of grooves 23.

The invention claimed is:

1. A high-voltage insulator comprised of: at least two separate insulators that can be joined to create a post and that each have an essentially rotation-symmetrical support tube made of glass-fiber-reinforced epoxy resin and having an empty internal space, respective top and bottom metallic flanges that surround top and bottom ends of the respective support tube and close the respective tube's empty internal space with an air-tight seal relative to the outer atmosphere, and a shielding of silicone that fits around each support tube, a tubular coupling piece connecting the at least two insulators in such a way that the respective empty internal spaces of the at least two insulators form a common gas space and pressure between the spaces is equalized through the coupling piece; and at least one fastener anchoring the coupling piece to one of the flanges.

2. The high-voltage insulator according to claim 1, wherein the coupling piece is a detachable plug-type connector.

3. The high-voltage insulator according to claim 1, wherein each internal space of each insulator is filled with insulating gas.

4. The high-voltage insulator according to claim 1, wherein the bottom flange of the bottom insulator includes a connection point to enable filling with insulating gas or connection to a monitoring device.

* * * * *